US005346451A

United States Patent [19]

Miller

[11] Patent Number: 5,346,451

[45] Date of Patent: Sep. 13, 1994

[54] EXERCISE APPARATUS WITH TELESCOPING POLE PIECES

[75] Inventor: Randolph F. Miller, Mount Vernon, Wash.

[73] Assignee: Tunturi, Inc., Redmond, Wash.

[21] Appl. No.: 10,348

[22] Filed: Jan. 28, 1993

[51] Int. Cl.[5] ..... A63B 21/008

[52] U.S. Cl. ..... 482/112; 482/52; 482/54; 482/70

[58] Field of Search ..... 482/51, 52, 53, 54, 482/62, 70, 71, 112, 113

[56] References Cited

U.S. PATENT DOCUMENTS

| | | | |
|---|---|---|---|
| 177,251 | 5/1876 | Johnson | 482/112 |
| 2,068,578 | 1/1937 | Stronach | 482/113 |
| 4,489,933 | 12/1984 | Fisher et al. | 482/28 |
| 4,572,500 | 2/1986 | Weiss . | |
| 4,645,201 | 2/1987 | Evans | 482/70 |
| 4,679,786 | 7/1987 | Rodgers . | |
| 4,743,015 | 5/1988 | Marshall . | |
| 4,832,335 | 5/1989 | Tong | 482/112 |
| 4,948,121 | 8/1990 | Hagheim et al. | 482/70 |
| 4,960,276 | 10/1990 | Feuer et al. . | |
| 5,000,442 | 3/1991 | Dalebout et al. . | |
| 5,074,550 | 12/1991 | Sloan | 482/29 |
| 5,108,093 | 4/1992 | Watterson . | |
| 5,152,732 | 10/1992 | Sayre | 482/112 |
| 5,199,932 | 4/1993 | Liao | 482/113 |

FOREIGN PATENT DOCUMENTS

| | | | |
|---|---|---|---|
| 0369208 | 1/1907 | France | 482/128 |

OTHER PUBLICATIONS

NordicTrack Catalog p. 12, in part relating to Power Walking Sticks, 1992.

*Primary Examiner*—Stephen R. Crow
*Assistant Examiner*—Jeanne M. Mollo
*Attorney, Agent, or Firm*—Graybeal Jackson Haley & Johnson

[57] ABSTRACT

Longitudinally extensible and shortenable pump poles designed for hand and arm action in dual-action exercise apparatus such as cross country ski exercises and dual-action climbers, treadmills and the like, such pump poles being fixedly attached to the apparatus base rearwardly thereof and manipulated concurrently with or independently of reciprocating leg action. Each pump pole has inner and outer telescoping tubes and an air pressurizable chamber providing greater resistance to pole shortening movement than occurs during pole lengthening movement. Hand and arm movement by the user when reciprocating the pole handles simulates the hand and arm movement of a person actually moving over ground.

13 Claims, 4 Drawing Sheets

EXERCISE APPARATUS WITH TELESCOPING POLE PIECES

BACKGROUND OF THE INVENTION

1. Field of the Invention

The present invention relates to dual-action exercise apparatus and more particularly to such apparatus involving means enabling reciprocating movement of both hands and feet, such as in cross country ski exercisers and dual-action treadmills, climbers and the like.

2. Description of the Prior Art

Cross country ski exercisers are typical of exercise apparatus with a so-called dual action, i.e. with both leg and arm movement to simulate movement over the ground such as in cross country skiing. Typically, in such exercise apparatus, pole movement by hand actuation typically involves the poles being pivotally movable relative to the base structure, as in Marshall 4,743,015 (at 22), Dalebout 5,000,442 (at levers 50, 52), and Watterson 5,108,093 (at 24, 26). Ski simulating exercisers are also known which involve reciprocating slide members for both the feet and ski poles, such as disclosed in Rodgers 4,679,786 (at 65), and Feuer 4,960,276 (at 38).

In these known dual action exercise apparatus the Doles or handles or levers provided for hand and arm movement are characteristically of fixed length with the movement being of a pivotal nature or with the lower end of the pole or the like moved horizontally relative to the base structure in a reciprocating manner. In either of these arrangements the pivotal or reciprocating movement of the poles or the like is inherently somewhat artificial in terms of not accurately simulating the hand and arm polling action of a person actually .moving over ground.

SUMMARY OF THE INVENTION

It is an object and feature of the present invention to provide in dual-action exercise apparatus pole means enabling hand and arm manipulation which more accurately simulates the polling action as it would occur with the user actually moving over ground.

It is a further and related object and feature of the invention to provide in dual-action exercise apparatus hand engaged pole means which is simple and durable in nature, fixed at the lower end thereof to stationary base structure, and is reciprocably extensible and shortenable responsive to arm and hand action.

It is a further object and feature of the present invention to provide such poles means in dual-action exercise apparatus wherein the lengthening and shortening the poles relative to the base of the apparatus is characterized by a pumping action simulating the polling movement of a user when actually moving over ground, such pumping action being in the nature of the pump handle movement of a conventional bicycle pump, i.e. with a lengthening or up stroke involving relatively low resistance to movement and with a shortening or down stroke involving relatively greater resistance to movement, with the latter resistance to movement being selectively variable to meet the particular exercise need of the user.

It is another object and feature of the present invention to provide in varying length hand engaged poles in a dual-action exercise apparatus of a mounting arrangement for such poles which is of a fixed nature with respect to the base of the apparatus yet which incorporates a resilient interconnection between the fixed base and the pole, such as by a coil spring, to enable limited pivotal movement of the pole while being hand manipulated with a pumping action.

These and other objects, features, advantages and characteristics of apparatus according to the present invention will become apparent from the accompanying illustration and following description of preferred embodiments thereof.

DESCRIPTION OF THE PREFERRED EMBODIMENTS

Figure 1:
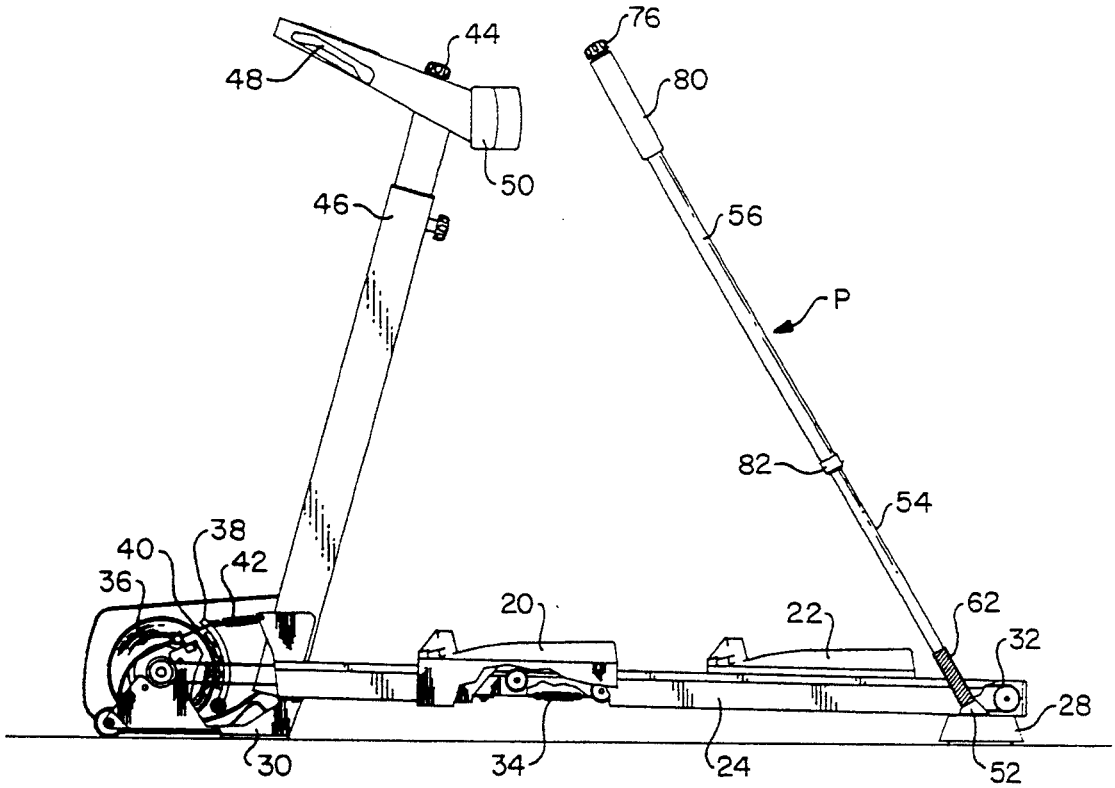
FIG. 1 is a side elevational view of a dual-action ski exerciser embodying a preferred form of ski pole simulating poles according to the present invention.

The dual-action ski exerciser shown in FIGS. 1–4 is of generally conventional construction and mode of operation except for its ski pole simulating poles. Thus, foot engaged supports 20, 22 are arranged in a known manner to reciprocate on tracks 24, 26 which are supported by base members 28, 30, in a manner similar to the foot engaged pads and parallel rails on base members in the apparatus shown in Marshall U.S. Pat. No. 4,743,015. Also, in a manner conventional per se, the foot engaged pedals 20, 22 are reciprocably linked together through belting 32 maintained under tension by spring means 34, with a resistance loading on the cable means which is magnetically selectively variable by means of flywheel 36 on which a variable braking effect is exerted by pivotally movable magnets 38, such movement being through lengthwise movement of belt 40 which is maintained taut by tension spring 42, the movement of belt 40 being responsive to rotation of knob 44 on post 46, all in a manner conventional per se such as shown in Saarinen U.S. Pat. No. 5,031,901. Post 46 carries fixed handholds as at 48 and a waist engageable support 50 for use by the user as desired.

Figure 2:
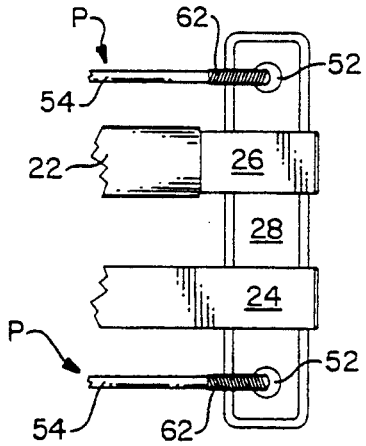
FIG. 2 is a detail plan view of the rear portion of the base and the lower portions of the poles of the ski exerciser shown in FIG. 1.
Figure 3:
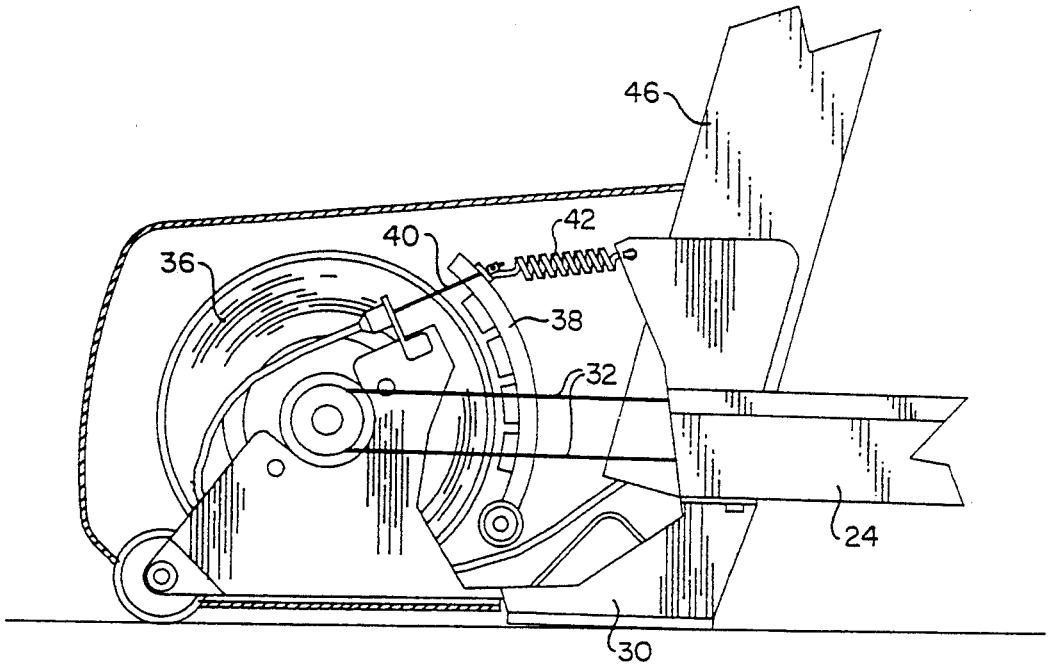
FIG. 3 is a detail side view on an enlarged scale with certain parts broken away of the forward portion of the ski exerciser shown in FIG. 1.
Figure 4:
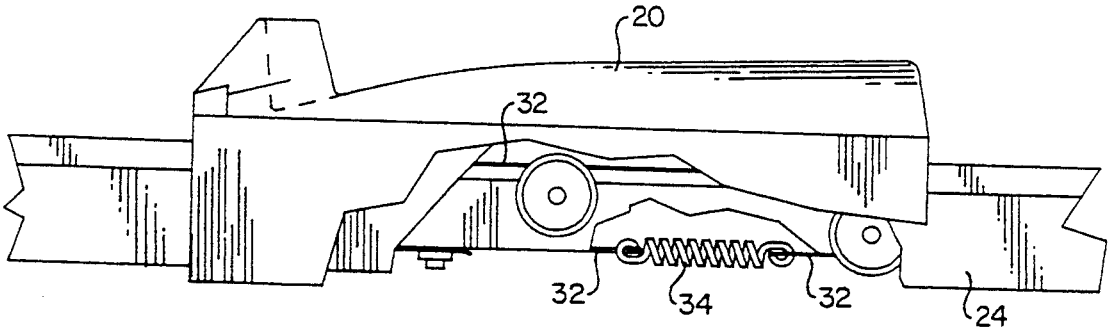
FIG. 4 is a detailed view on an enlarged scale with certain parts broken away for clarity of illustration of a foot support and adjacent area of the ski exerciser shown in FIG. 1.

In accordance with the invention, the skiing simulated exercise apparatus shown in FIGS. 1–4 includes a pair of ski pole simulating pole members, the left hand one of which is indicated generally in FIG. 1 at P, and the lower portions of which are shown at P in FIG. 2, which pole members are fixedly mounted at the lower end fixtures 52 thereof on rear base member 28.

Figure 5:
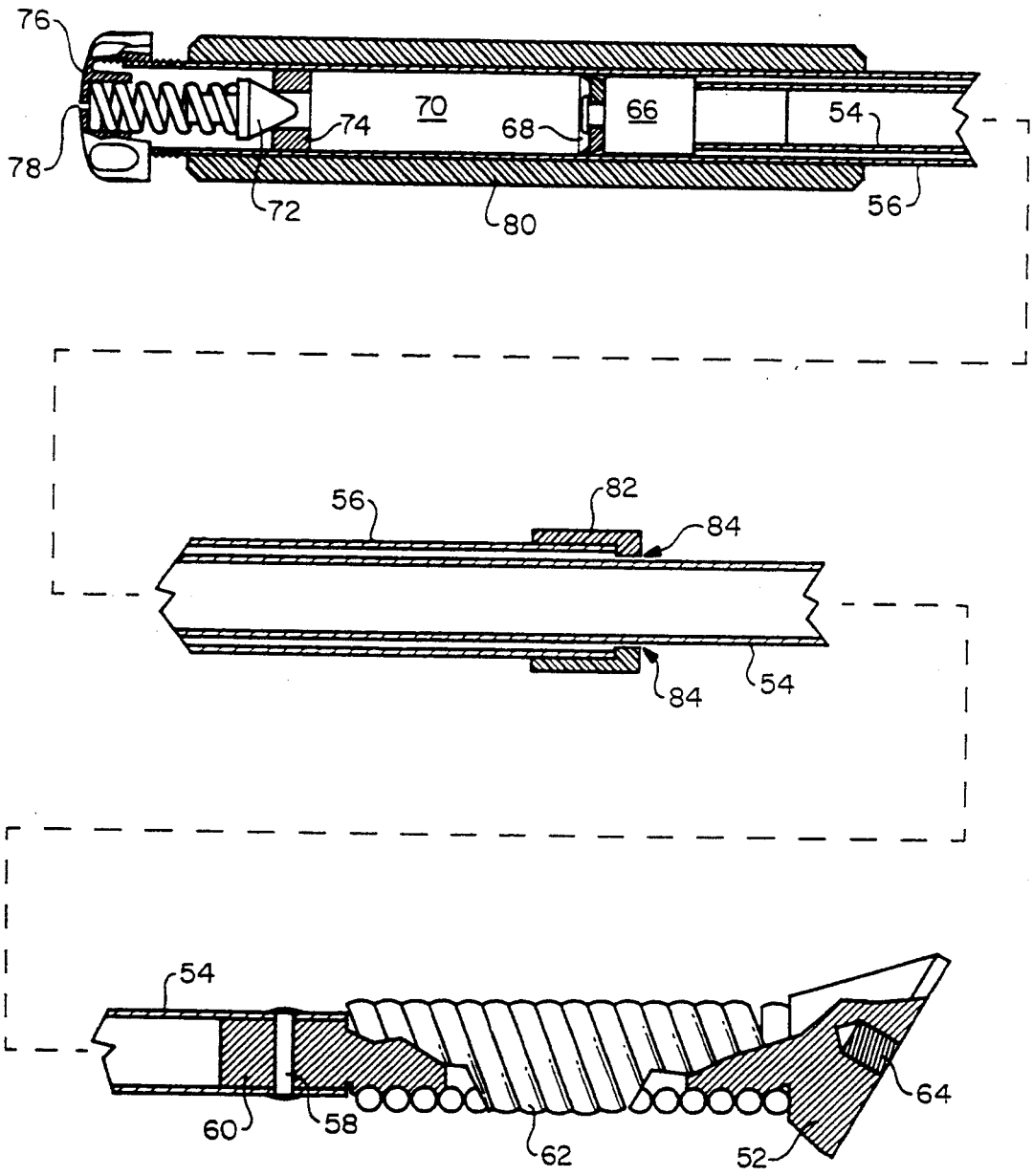
FIG. 5 is an enlarged and primarily cross-sectional view of one of the ski pole simulating poles of the ski exerciser shown in FIG. 1.

The construction of each pole member P, as shown in detail in FIG. 5, involves an inner tube 54 and an outer tube 56 in telescoped relation, the inner tube 54 being connected at its lower end by pin 58 to a plug 60 threaded in its lower portion to rigidly engage the upper end of coil spring 62 which at its lower end is in turn threaded to attachment fixture 52 which is in turn attached by a bolt (not shown) engaging threads 64 in fixture 52. Inner tube 54 at its upper end comprises a piston 66 and a U-cup seal 68. Cooperating with the U-cup seal to form a pressurized air chamber 70 is spring-loaded valve 72 and valve seat 74. Rotatable knob 76 is in threaded engagement with the outer tube 56 at the top thereof and is provided with an air exhaust hole 78. In the upper portion of the outer tube 56, a hand grip 80, engageable by the user's hand, encircles the outer tube 56.

The outer tube 56 is provided at its lower end with an end cap 82 which is configured to leave a cylindrical gap at 84 between it and the inner tube 54. As wi 11 be apparent, the construction provides for a telescoping movement between the outer tube 56 and inner tube 5 4 and an air pumping action very similar to that of a conventional bicycle pump. Upon extension or elongation of the pole by upward movement of the hand grip 80 and outer tube 56, ambient air is drawn in through the gap 84 and through the space between the outer tube 56 and inner tube 5 4 and the space between piston 66 and outer tube 56 and past the U-cup seal 68 into the air pressure chamber 70, all with relatively low resistance. Then, upon downward, shortening movement of the outer tube 56 relative to the inner tube 5 4, the U-cup seal 68, by reason of the relatively high pressure incurred by the reduction of volume of the air pressure chamber 70, seals against the outer tube 56 and the pressure and consequent resistance to further movement increases in the air pressure chamber 70 until the pressure is sufficient to upset the valve 72 from its seat 74 and permit escape of some air past the valve seat 74 and out the exhaust opening 78. Then, upon renewed extension movement of the outer tube 56 relative to the inner tube 54, the valve 72 reseats and air is again brought into the pressure chamber 70 past the U-cup seal 68 in the same manner as during the first extension stroke.

As will be understood, repeated telescopic movement of the upper portion of the pole by hand and arm action occurs in a generally rectilinear manner by reason of the pole being fixedly attached at its lower end to the base member and it is this action with primary resistance occurring during the downward and pole shortening movement which simulates a polling action as it occurs during actual movement over ground. While the telescoping action is essentially rectilinear, slight variations in the position of the upper end of the pole and angularly relative to the base member can occur incident to the pumping action and in the embodiment of the invention shown are accommodated by a coil spring 62 which is rigidly interconnected with both the fined fixture 52 and the lower end plug 60 of inner tube 54 but which can flex to a degree without bending or breakage of the pole tubes. Spring 62 is of sufficient rigidity to render the pole self-supporting when standing free such as shown in FIG. 1.

Figure 6:
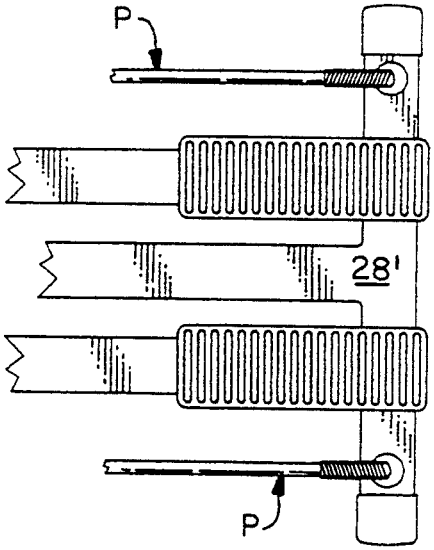
FIG. 6 is a detail plan view of the rear portion of the base and the lower portions of poles according to the invention attached rearwardly to the base of an otherwise conventional stairclimber type exercise apparatus.
Figure 7:
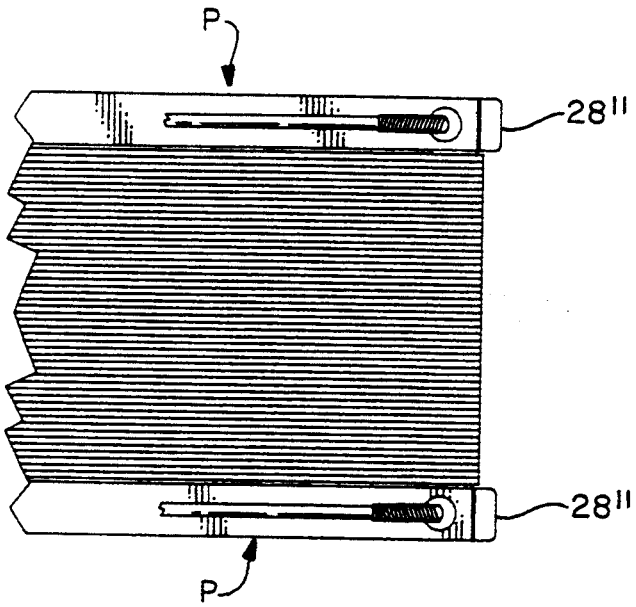
FIG. 7 is a detail plan view of the rear portion of the base and the lower portions of the poles according to the present invention attached to the base of an otherwise conventional treadmill type exercise apparatus.

As will be recognized, the telescopable, pump action exercise pole of the present invention is readily adaptable to usages with exercise apparatus other than the ski simulating exerciser apparatus illustrated and discussed specifically above. Thus, by way of other examples, poles like poles P, which for simplicity can be termed six, ply pump poles, can be employed for hand and arm action and mounted rearwardly on the base of climbers, treadmills and the like which are intended to be operated in a stationary manner but which enable the user to simulate movement over or relative to the ground with a polling movement of the hands and arms relative to the ground. Thus, for example, poles P are mountable on the rear portion of base member 28' of an otherwise conventional stairclimber as shown in FIG. 6, and rearwardly on the base 28" of an otherwise conventional treadmill, as shown in FIG. 7.

Since each pole member P is independently actuatable by the user, it is also evident that poles can be purchased separately and are readily added to existing apparatus such as single-action climbers or treadmills to provide a dual-action mode of operation thereof, as desired.

From the foregoing, these and other variations, Adaptations and modifications of the construction shown and described, consistent with the invention will occur to those skilled in the art to which the invention is addressed, within the scope of the following claims.

What is claimed is:

1. In a dual-action exercise apparatus of a type involving a fixed base and means on said base whereby a user can exercise by use of means enabling reciprocating movement of the legs and feet relative to the base and also by use of means enabling reciprocating arm and hand movement relative to the base, the improvement wherein said means enabling reciprocating arm and hand movement comprises at least one pump pole means with an inner tube and an outer tube in telescoped, partially overlapping relation, said inner tube having an end remote from the outer tube which is connected by resilient means to a fixture which in turn is mounted on the base of the exercise apparatus, said inner tube also having at its end within the outer tube seal means in engagement with the inner wall of said outer tube said outer tube at its end remote form the inner tube having hand engageable grip means and over-pressure release valve means which, with the inner wall of the outer tube and the seal means, forms an air chamber in which air is pressurized upon progressive movement of the inner tube into the outer tube and into which air is drawn past said seal means upon progressive movement of the inner tube out of the outer tube, said outer tube having the same inner diameter essentially throughout its length and said telescoped inner tube and outer tube being of a total length which is adapted to extend from about floor level to the hand level of an upright user, the said outer tube being of a length so that it extends most of the total length of the telescoped outer tube and inner tube and so that said air chamber provides pressurized air resistance during movement of the inner tube into the outer tube throughout most of the length of the tubes.

2. An exercise apparatus according to claim 1, comprising means at the top of the outer tube of the pump pole means for varying the setting of said over-pressure release valve means.

3. An exercise apparatus according to claim 2, wherein said over-pressure release valve means comprises a valve seat engaged by a spring loaded valve.

4. An exercise apparatus according to claim 3, wherein said seal means at the end of said inner tube comprises a U-cup seal.

5. An exercise apparatus according to claim 3, comprising means for varying the release pressure of the over-pressure release valve including a rotatable, threaded knob urging said spring loaded valve into said valve seat.

6. Exercise apparatus according to claim 1, wherein the resilient means connecting the inner tube to the base mounted fixture comprises coil spring means enabling the attached pump pole means to pivotally flex in any direction radially of the longitudinal axis of the pump pole means.

7. An exercise apparatus according to claim 1, wherein said seal means associated with the pressurized air chamber has means for providing greater resistance during shortening movement of the tubes than during lengthening movement thereof.

8. An exercise apparatus according to claim 1, wherein said at lest one pump pole means comprises two pump pole means each attached at a respective side of the apparatus base and each longitudinally extensible and shortenable relative to said base independently of the other and independently of any reciprocating movement of the legs and feet of the user of the apparatus.

9. Exercise apparatus according to claim 8, wherein said resilient means comprises two coil spring means respectively connecting the two inner tubes to the base mounted fixture and enabling the attached pump pole means to pivotally flex in any direction radially of the longitudinal axes of the pump poles.

10. An exercise apparatus according to claim 8, wherein said exercise apparatus is selected from the group consisting of cross-country ski exercise apparatus, dual-action treadmills, and dual-action climbers.

11. Exercise apparatus according to claim 10, wherein said resilient means comprises respective coil spring means connecting the two inner tubes to the base mounted fixture and enabling the attached pump pole means to pivotally flex in any direction radially of the longitudinal axes of the pump pole means.

12. An exercise apparatus according to claim 1, wherein the apparatus is configured to enable the user to simulate cross-country skiing movements and comprises an elongated base, foot engageable supports reciprocably movable forwardly and rearwardly of said base, and wherein said at least one pump pole means comprises two hand engageable pump pole means which are affixed at respective sides near the rearward end of said base and terminate in said hand engageable grip means above and at respective sides of said base.

13. In a dual-action exercise apparatus of a type involving a fixed base and means on said base whereby a user can exercise by use of means enabling reciprocating movement of the legs and feet relative to the base and also by use of means enabling reciprocating arm and hand movement relative to the base, the improvement wherein said means enabling reciprocating arm and hand movement comprises a pair of pump pole means, each with inner and outer tubes in telescoped, partially overlapping relation, each said inner tube having an end remote from the outer tube which is connected through spring means to the base of the exercise apparatus, each said inner tube also having at its end within the associated outer tube a pressure seal engaging the inner wall of the outer tube, said associated outer tube at its end remote from the inner tube having a hand engageable grip means and a variable pressure release valve which, with the inner wall of the outer tube and the seal means, form an air chamber in which air is pressurized upon progressive movement of the inner tube into the outer tube and into which air is drawn past said seal means upon progressive movement of the inner tube out of the outer tube, each said associated outer tube having the same inner diameter essentially throughout its length and providing pressurized air resistance during movement of the inner tube into the outer tube throughout most of the length of the tubes in a manner simulating the actual downward movement of a user's hands and arms which would occur if the user were actually polling over ground.

* * * * *